US006622359B2

(12) United States Patent
Legl

(10) Patent No.: US 6,622,359 B2
(45) Date of Patent: Sep. 23, 2003

(54) APPARATUS FOR NEEDLING A NON-WOVEN

(75) Inventor: Ludwig Legl, Buchkirchen (AT)

(73) Assignee: Textilmaschinenfabrik Dr. Ernst Fehrer Aktiengesellschaft, Leonding (AT)

( * ) Notice: Subject to any disclaimer, the term of this patent is extended or adjusted under 35 U.S.C. 154(b) by 16 days.

(21) Appl. No.: 10/021,516

(22) Filed: Oct. 30, 2001

(65) Prior Publication Data

US 2002/0066169 A1 Jun. 6, 2002

(30) Foreign Application Priority Data

Dec. 6, 2000 (AT) ..... 2039/2000

(51) Int. Cl.[7] ..... D04H 18/00
(52) U.S. Cl. ..... 28/114; 28/107
(58) Field of Search ..... 28/107, 114, 108, 28/109, 110, 111, 112, 113, 115; 112/80.4, 80.45, 80.42, 80.41

(56) References Cited

U.S. PATENT DOCUMENTS 3,845,529 A * 11/1974 Van Deusen et al. ..... 28/114
3,849,845 A * 11/1974 Obenaus ..... 28/107
4,777,706 A * 10/1988 Stanislaw ..... 28/110
4,891,870 A * 1/1990 Muller ..... 28/107
5,732,453 A 3/1998 Dilo et al. ..... 28/114
6,000,112 A * 12/1999 Ollinger et al. ..... 28/107
6,161,269 A * 12/2000 Dilo et al. ..... 28/114
6,266,856 B1 * 7/2001 Fehrer et al. ..... 28/114
6,389,665 B1 * 5/2002 Fuchs et al. ..... 28/114

FOREIGN PATENT DOCUMENTS

DE 19615697 3/1997
EP 0892102 1/1999

* cited by examiner

*Primary Examiner*—Amy B. Vanatta
(74) *Attorney, Agent, or Firm*—Collard & Roe, P.C.

(57) ABSTRACT

An apparatus is described for needling a non-woven (2) with at least one support (6) for a needleboard (4) held in a frame (12) and with two parallel eccentric drives (7, 8) which are disposed between the frame (12) and the needleboard support (6) and are made of two parallel eccentric shafts (9 and 10) each for the needleboard drive in the needling direction on the one hand and in the direction of passage of the non-woven on the other hand. In order to provide advantageous constructional conditions it is proposed that an intermediate support (13) is provided between the needleboard support (6) and the frame (12) and that the intermediate support (13) is guided with respect to the frame (12) and the needleboard support (6) with respect to the intermediate support (13) in circular paths by way of the two eccentric drives (7, 8) which are disposed on the one hand between the frame (12) and the intermediate support (13) and on the other hand between the intermediate support (13) and the needleboard support (6).

2 Claims, 2 Drawing Sheets

APPARATUS FOR NEEDLING A NON-WOVEN

FIELD OF THE INVENTION

The invention relates to an apparatus for needling a non-woven with at least one support for a needleboard held in a frame and with two parallel eccentric drives made of two parallel eccentric shafts each for the needleboard drive in the needling direction on the one hand and in the direction of passage of the non-woven on the other hand.

DESCRIPTION OF THE PRIOR ART

In order to increase the non-woven advance it is known (DE 196 15 697 A1) to provide an additional needleboard drive which reciprocates in the direction of passage of the non-woven, so that the non-woven advance is increased by the movement component of the needleboard in the direction of passage of the non-woven. Said additional drive for the needleboard is formed like the main drive acting in the direction of the needle penetration by an eccentric drive which is articulated by way of connecting rods on the needle beam. The arrangement of two parallel eccentric shafts leads to a parallel guidance of the needle beam because the connecting rods form the guide rods of a parallelogram of links. In order to set the stroke the connecting rods can be held on the eccentric shafts by way of adjusting eccentrics, by means of which the eccentricity of the eccentric shafts is changed.

If a parallel guidance of the needle beam is omitted (EP 0 892 102 A2), the connecting rods of the two eccentric shafts can be coupled with one another by way of a coupling bridge which acts on the needle beam by way of a guide rod. In such an arrangement of the eccentric drive for the needleboard drive in the direction of passage of the non-woven, the needleboard advance in the direction of passage of the non-woven can be set by a respective choice of the mutual angular position of the two eccentric shafts of the eccentric drive. The price to be paid for this simple possibility for setting the needleboard drive in the direction of passage of the non-woven is the disadvantage that the needleboard which is articulated in the needle penetration direction on the connecting rods of the eccentric drive for the needleboard drive performs a reciprocating swiveling movement with the disadvantage that the thus produced swiveling movements of the needles cause an enlargement of the penetration holes in the non-woven during the needle penetration. Apart from that, there are considerable constructional efforts required for needleboard supports which are articulated by way of connecting rods on eccentric drives.

SUMMARY OF THE INVENTION

The invention is thus based on the object of providing an apparatus for needling a non-woven of the kind mentioned above in the aforementioned manner in such a way that on the one hand, a simple construction for needleboard operation is enabled in the direction of needle penetration as well as in the direction of passage of the non-woven, and that on the other hand preconditions are created for an advantageous setting of the needleboard advance in the direction of passage of the non-woven without requiring any pivoting of the needleboard.

This object is achieved by the invention in such a way that an intermediate support is provided between the needleboard support and the frame and that the intermediate support is guided with respect to the frame and the needleboard support with respect to the intermediate support by way of the two eccentric drives which are disposed on the one hand between the frame and the intermediate support and on the other hand between the intermediate support and the needleboard support.

Since as a result of these measures the intermediate support is held directly on the eccentrics of the eccentric shafts of the one eccentric drive as held in the frame, and on whose eccentrics the needleboard support rests directly, a simplification of construction is obtained in comparison with eccentric drives which act by way of connecting rods on the needleboard support, leading to the effect that both eccentric drives influence the movement of the needleboard support both in the direction of needle penetration as well as in the direction of passage of the non-woven. Under the assumption of a coinciding eccentricity and a dead center position of the two eccentric drives which is mutually offset by 180° in the direction of the viewed direction of stroke, their strokes cancel one another out for example, whereas in the case of a corresponding angular position of the eccentric drives a total stroke is obtained which corresponds to the sum total of the two individual strokes. If the two eccentric drives are driven in opposite direction, opposite strokes in the direction of advance which mutually cancel each other out are obtained in a corresponding dead center position in the direction of needle penetration, so that the needleboard is driven exclusively so as to reciprocate in the direction of needle penetration. As a result of adapting the mutual angular positions, the eccentricities and the direction of rotation of the eccentric drives it is thus possible to create drive conditions for the needleboard which advantageously meet the respective requirements both with respect to the direction of needle penetration as well as the advance in the direction of passage of the non-woven.

An additional factor is that for adapting the needleboard drive to different advances in the direction of passage of the non-woven it is merely necessary to set the mutual angular position of the eccentric drives. The corresponding angular position of the two eccentric shafts of each eccentric drive secures a movement of the needleboard parallel to itself along a closed orbit, so that swiveling movements of the needleboard can be excluded, although the needleboard can also be superimposed with a swiveling movement in special cases.

BRIEF DESCRIPTION OF THE DRAWING

The subject matter of the invention is shown by way of example in the drawings, wherein.

DESCRIPTION OF THE PREFERRED EMBODIMENT

Figure 1:
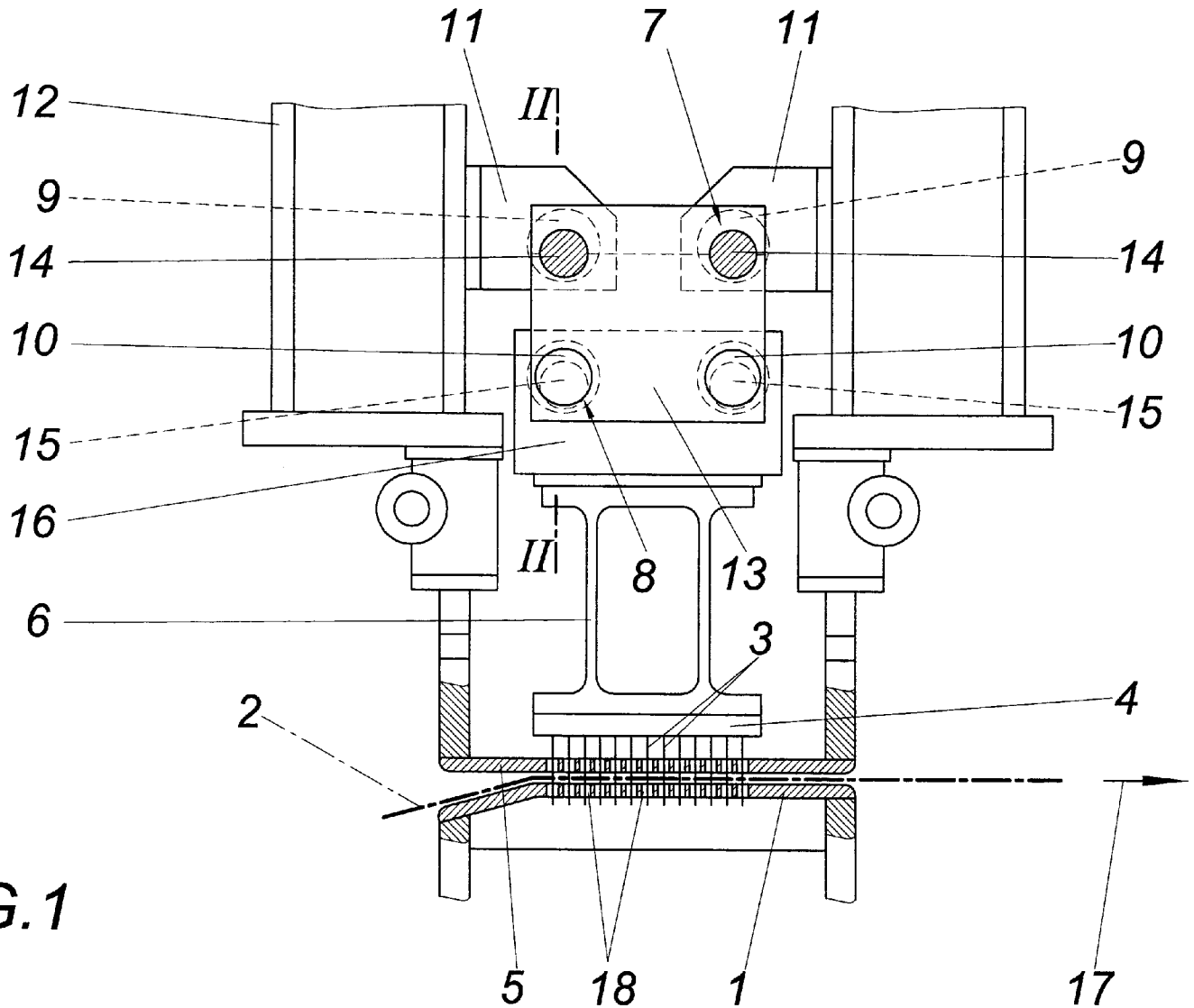
FIG. 1 shows an apparatus in accordance with the invention for needling a non-woven in a schematic, partly elevated side view.
Figure 2:
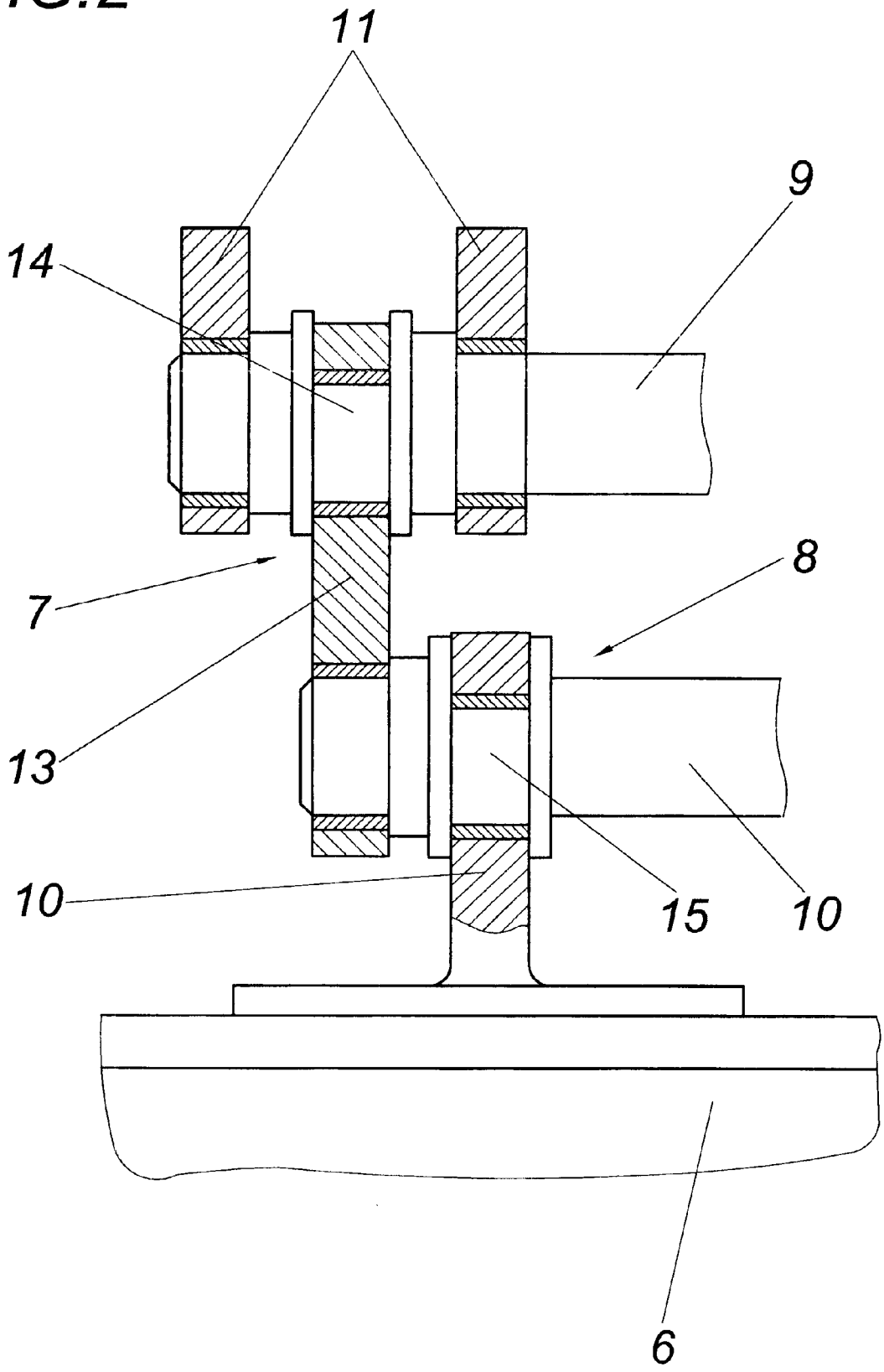
FIG. 2 shows the apparatus according to a sectional view of line II—II of FIG. 1 on a larger scale.

The illustrated apparatus for needling a non-woven is provided with a stitch base 1 for guiding a non-woven 2 which is needled with the help of needles 3 of a needleboard 4. A stripper 5 which is adjustable with respect to its distance from stitch base 1 prevents that the non-woven 2 is lifted off from the stitch base during the retraction of the needles 3. The needleboard 4 which is held in a support 6 is driven with the help of two eccentric drives 7 and 8 which are each provided with eccentric shafts 9 and 10, respectively.

Whereas the eccentric shafts 9 of the eccentric drive 7 are held in bearing brackets 11 of a frame 12, the eccentric shafts 10 of the eccentric drive 8 are held in an intermediate support 13 which itself is held on the eccentrics 14 of eccentric shafts 9.

According to the bearing of the intermediate support 13 on the eccentric shafts 9, the needleboard support 6 is held on the eccentrics 15 of the eccentric shafts 10, namely by way of bearing cheeks 16 which are placed on the needleboard support 6.

The drive of the eccentric shafts 9 and 10 is preferably performed by means of motors which are controllable with respect to their mutual angular position. Whereas the drive connection to the eccentric shafts 9 which are held stationarily does not pose any problems, it is necessary to consider for the drive of the eccentric shafts 10 the movement of the intermediate support 13 along a circular path as defined by the eccentric 14 of the eccentric drive 7. Due to the predetermined circular path it is appropriate to use for the drive of the eccentric drive 8 a planetary gear system with an internal ring gear adapted to the circular path of the eccentric 14.

Since the movements of the two eccentric drives 7 and 8 overlap one another, the needleboard support 6 can be adapted in the case of predetermined eccentricities of the eccentrics 14 and 15 of the eccentric shafts 9 and 10 to different conditions by a respective choice of the mutual angular position of the eccentric 14 with respect to eccentric 15, especially with respect to a needleboard advancement in the direction of passage of the non-woven 17. The additional movement component of the needleboard 4 in the direction of passage 17 of the non-woven must be considered in the arrangement of the pass-through openings 18 for the needles 3 in the stitch base 1 and in the stripper 5 in the form of oblong holes.

The invention is naturally not limited to the illustrated embodiment which for the purpose of clarity of the illustration merely shows the principal drive conditions for the needleboard support 6 and leaves open the measures requirement for the balancing of masses.

What is claimed is:

1. An apparatus for needling a non-woven web in a needling direction, comprising (a) a frame, (b) a needleboard held in the frame on a support, the non-woven web moving along the needleboard in a direction of passage, (c) two parallel eccentric drives disposed between the frame and the needleboard support, the eccentric drives respectively driving the needleboard support in the direction of passage of the non-woven web and in the needling direction, each eccentric drive comprising (1) two parallel eccentric shafts extending perpendicularly to the direction of passage, (d) an intermediate support holding the needleboard support and disposed between the frame and the needleboard support, (1) one of the eccentric drives being mounted on the frame and the intermediate support being mounted on the eccentric shafts of the other eccentric drive, and (2) the one eccentric drive driving the intermediate support in a circular path relative to the frame while the other eccentric drive drives the needleboard support in a circular path relative to the intermediate support.

2. The apparatus of claim 1, wherein the two eccentric drives have an angular position which is adjustable.

* * * * *